US005863075A

United States Patent [19]

Rich et al.

[11] Patent Number: 5,863,075

[45] Date of Patent: Jan. 26, 1999

[54] INTEGRATED IMAGE SCRAMBLING AND DESCRAMBLING

[75] Inventors: Benny R. Rich, Oakwood; James J. Carides, Lawrenceville, both of Ga.

[73] Assignee: Dittler Brothers Incorporated, Atlanta, Ga.

[21] Appl. No.: 771,383

[22] Filed: Dec. 16, 1996

Related U.S. Application Data

[63] Continuation-in-part of Ser. No. 567,364, Dec. 4, 1995, Pat. No. 5,769,458.

[51] Int. Cl.[6] ..... B42D 15/00

[52] U.S. Cl. ..... 283/94; 283/901; 283/72

[58] Field of Search ..... 283/72, 73, 94, 283/93, 101, 17, 56, 901, 903; 427/256; 347/101, 105, 107

[56] References Cited

U.S. PATENT DOCUMENTS

| | | | |
|---|---|---|---|
| 4,586,711 | 5/1986 | Winters et al. | 283/901 X |
| 5,002,313 | 3/1991 | Salvatore | 283/56 X |
| 5,346,258 | 9/1994 | Behm et al. | 283/102 |
| 5,601,887 | 2/1997 | Rich et al. | 283/94 |
| 5,769,458 | 6/1998 | Carides et al. | 283/102 |

*Primary Examiner*—Willmon Fridie, Jr.
*Attorney, Agent, or Firm*—Dean W. Russell; Kilpatrick Stockton LLP

[57] ABSTRACT

A method for printing a scrambled image and decoding mechanism in registration one on top of the other. The decoding mechanism is not immediately apparent upon inspection. A person decodes the scrambled image by exposing the decoding mechanism.

14 Claims, 3 Drawing Sheets

DITTLER
BROTHER

2

INTEGRATED IMAGE SCRAMBLING AND DESCRAMBLING

RELATED APPLICATIONS

This application is a continuation in part of application Ser. No. 08/567,364, filed Dec. 4, 1995, entitled "Cards having Variable Benday Patterns" (the disclosure of which being hereby incorporated by reference as if fully set forth herein) now U.S. Pat. No. 5,769,458.

FIELD OF THE INVENTION

This invention relates to the scrambling and unscrambling of images, and more particularly to a method and apparatus that integrates an unscrambling device with a substrate onto which a scrambled image has been printed.

BACKGROUND OF THE INVENTION

Various scrambling techniques have been devised to print sensitive information and images onto a medium so that they cannot be read by unauthorized individuals. A separate decoding device is provided which, when laid over the printed image, renders the scrambled information or image legible. These scrambling techniques have been proposed for use in applications where security is needed and ready access to the encoded material must be available. For example, to facilitate banking transactions it has been proposed to encode the signatures of depositors into bank passbooks. The bank, which possesses a decoder for the scrambled signature, can readily verify the authenticity of a signature when funds are withdrawn. It has similarly been proposed to encode signatures to the back of credit cards for quick and easy verification of the identity of the person using the card.

Scrambling techniques are also used for promotional purposes. Because the techniques require a participant in the promotion to decode a hidden image, such techniques often are entertaining. It also has been proposed to employ scrambling techniques in games of chance, such as lottery cards, that are sold at the retail level. The techniques are suitable for such application, because a consumer would not know whether the game piece he or she has purchased is a winner until the game piece has been decoded.

A particular technique for scrambling information or images involves suppressing from view some of the area of an image printed in a figure. The image is typically suppressed from view in an ordered manner, such as along a series of parallel stripes. For convenience, the series of parallel stripes, or other ordered manner in which the image is suppressed, will be referred to herein as a "base image." Because the image often can still be discerned even though part of it has been suppressed, extraneous and meaningless imagery is printed to the figure where the image has been suppressed, and also in the background of the image, at about the same coloration and density as the portion of the printed image that has not been suppressed. The extraneous and meaningless imagery thereby confuses and scrambles the remaining image, rendering it unintelligible.

A mask may be created from the base image. When the mask is laid over the scrambled image it obscures the extraneous imagery and leaves the unsuppressed parts of the image exposed to view, so that one is able to decode the scrambled image. This technique for encoding images can take many forms, several of which are described in U.S. Pat. No. 2,952,080 to Avakian et al., U.S. Pat. No. 3,621,589 to Jones et al., U.S. Pat. No. 3,279,095 to Carlson, and U.S. Pat. No. 3,227,474 to Hoeflinger. For simplicity, the disclosure of each of the foregoing patents is hereby incorporated by reference as if fully set forth herein.

The technique disclosed in these patents can be practiced either manually or electronically. The technique can be practiced manually, for example, by physically erasing portions of an image and physically printing the meaningless background information to the figure. The technique can also be practiced by photographic or other means whereby images are superimposed onto one another to create the scrambled image. The technique further can be practiced electronically by programmed manipulation, suppression, and superimposition of digitized images of the meaningful scrambled image and the meaningless background imagery.

Ordered base images that comprise an organized and uniform arrangement of opaque and transparent units often are employed in existing scrambling techniques. Ordered configurations typically are employed so that a person can more readily register a decoder with a scrambled image to unscramble the image. While ordered base image configurations make decoding scrambled images easier, they also render the scrambled image less secure against unauthorized decoding. As a base pattern becomes more ordered, the risk that an unauthorized person can discern a scrambled image without using the decoder increases. Security is further compromised by the fact that in many instances only one or a few base images are used to scramble a tremendous number of images, because of the difficulty of maintaining and using more than just a few decoding mechanisms. If someone were to decipher only one scrambled image without a decoder, then the person may be able to decode multiple scrambled images hidden with the same base image.

SUMMARY OF THE INVENTION

This invention eliminates the need for a secondary decoding medium, increases the number of scrambling techniques that suitably can be practiced, and generally increases the security associated with scrambling techniques. In cards produced by the present invention, the decoding mechanism and the scrambled image are printed in registration on top of one another onto the same card. The decoding mechanism is not immediately apparent upon inspection because it is either obstructed or otherwise hidden from view by, for example, printing the mechanism with a transparent ink. A person can decode the scrambled image by exposing the decoding mechanism.

Because the decoding mechanism and scrambled image are printed on top of one another, a person who unscrambles the image is not burdened with registering the decoder and the scrambled image. Complex techniques involving intricate base images and decoding mechanisms can thus be used to scramble images, because images can be scrambled without regard to the subsequent burden of registering the decoding mechanism and the scrambled image. The invention thus increases the number of suitable scrambling techniques, and decreases the risk that an unauthorized individual could decipher a scrambled image without using a decoding mechanism.

It is an object of this invention, therefore, to provide a novel means of decoding a scrambled image.

A further object of this invention is to eliminate the need for a separate decoder to decode a scrambled image.

A still further object of this invention is to provide novel uses for encryption techniques.

Yet another object of this invention is to eliminate the burden for a consumer or retailer to register a decoding mechanism with a scrambled image.

It is another object of this invention to permit novel encryption techniques.

Another object of this invention is to provide greater resolution of unscrambled images.

Other objects, aspects, and advantages of this invention will become apparent upon review of this specification, the drawings, and the claims.

DRAWINGS

FIG. 3 also is a top plan view of the decoding mechanism that would be used to decode images scrambled by the base image.

DETAILED DESCRIPTION

Figures 1, 2:
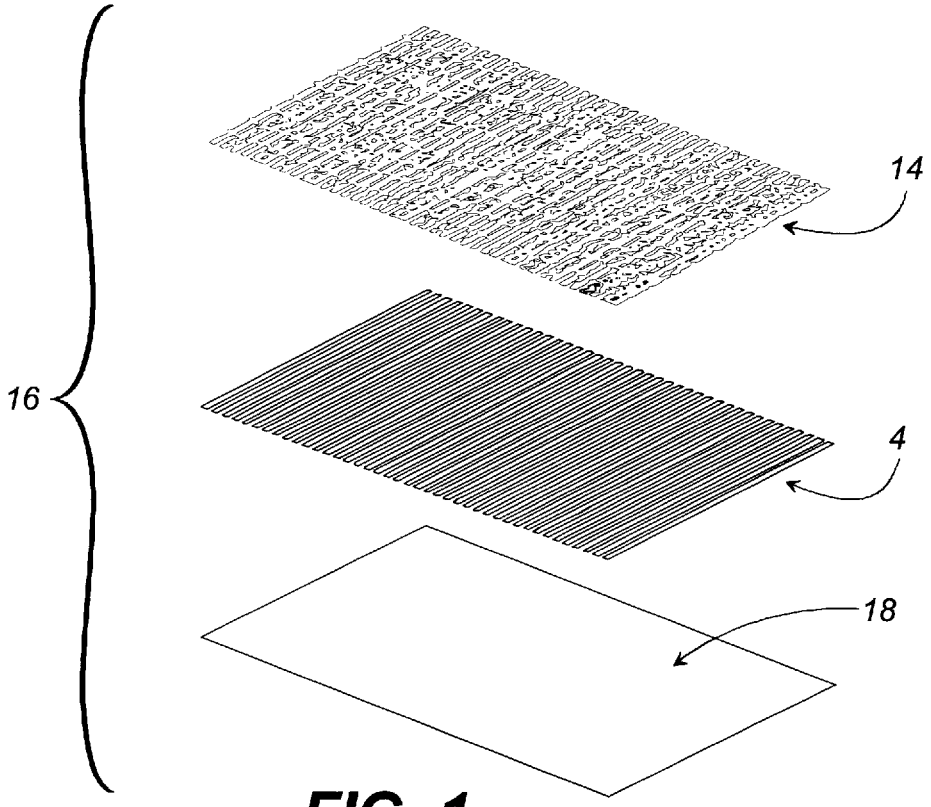
FIG. 1 is an exploded perspective view of a card onto which has been printed the scrambled image of FIG. 6 and the decoding mechanism of FIG. 3.
FIG. 2 is an exemplary image capable of being scrambled by the process of this invention.
Figure 3:
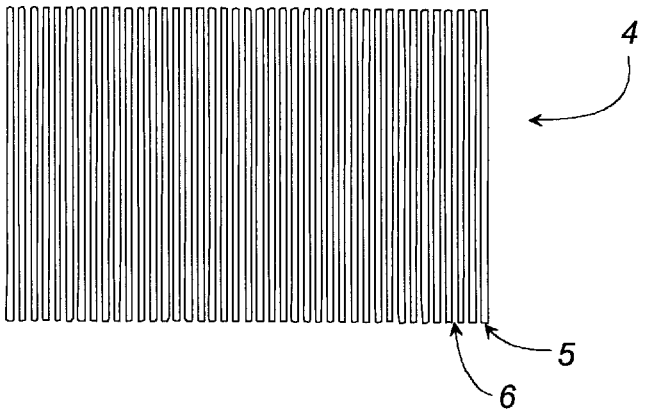
FIG. 3 is a top plan view of a base image used to scramble images by the bar encryption technique discussed herein.

FIG. 1 is an exploded perspective view of a card 16 comprising a substrate 18, a base image 4 printed to substrate 18, and a scrambled image 14 printed to substrate 18 over base image 4. Card 16 could be a promotional piece, a lottery card, or any other type of card with which the process of this invention suitably may be practiced.

Figure 4:
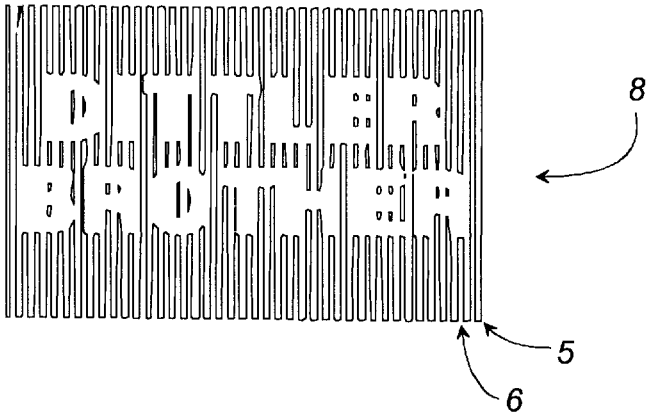
FIG. 4 is a top plan view of the exemplary image of FIG. 2 over which the base image of FIG. 3 has been laid.

Scrambled image 14 was prepared according the process depicted in FIGS. 2–6, by what will be referred to herein as the bar encryption technique. In electronic bar encryption an image to be scrambled, such as image 2 exemplified in FIG. 2, is first digitally encoded into a suitable medium such as a computer. Once encoded, a computer program manipulates the digital image to hide or suppress electronically a portion of it behind a base image, such as the base image 4 exemplified in FIG. 3, comprising a series of parallel opaque bars 5 and transparent vertical columns 6. The partly hidden image 8 which is thus obtained is shown in FIG. 4.

Figure 5:
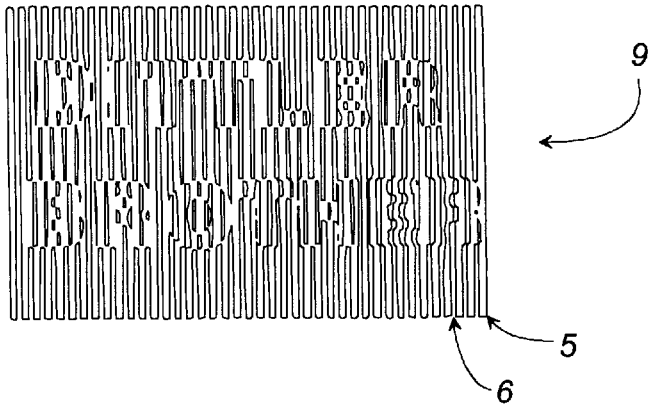
FIG. 5 is a top plan view of the image of FIG. 4 partly scrambled by phase transition of part of the base image.

After the image has been partly hidden by opaque bars 5, the bars are manipulated electronically to effect a partial phase transition. In the partial phase transition opaque bars 5 are made clear in the area over which the bars hide image 2. The partly scrambled image 9 which is obtained upon the phase transition is shown in FIG. 5.

Figure 6:
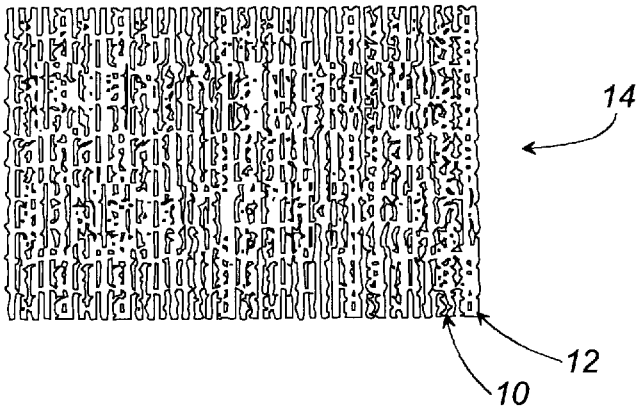
FIG. 6 is a top plan view of the image of FIG. 5 fully scrambled by the addition of clear and opaque pixels.

After image 2 has been partly scrambled by the overlay of base image 4 and subsequent phase transition, the image is further scrambled by the electronic addition of more or less random clear pixels 10 and opaque pixels 12 in the opaque and clear regions respectively of the figure. The scrambled image 14 thus obtained is illustrated in FIG. 6, and thereafter printed to substrate 18.

Other scrambling techniques can also be used to practice this invention. Indeed, any scrambling technique in which portions of a visible image are either erased or suppressed, or in which meaningless imagery is used to confuse the visible image, whether performed manually or electronically, is suitable for practicing the invention. Some of the suitable scrambling techniques are disclosed in the background section of this document.

Figure 7:
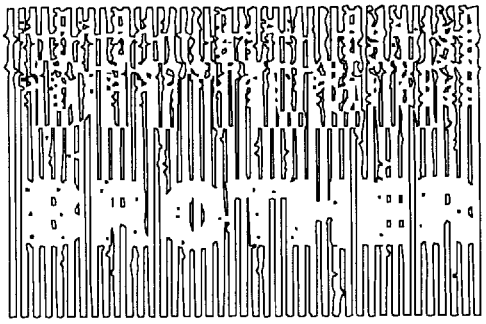
FIG. 7 is a top plan view of the fully scrambled image of FIG. 6, partly decoded, in which the decoding mechanism of FIG. 3 is in phase with the partly decoded image.
Figure 8:
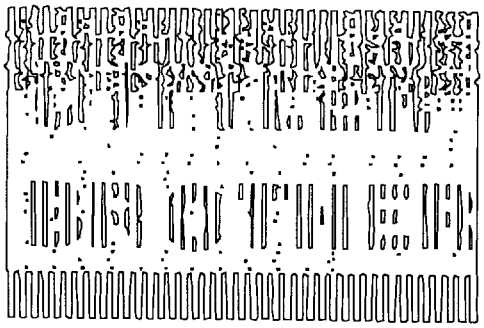
FIG. 8 is a top plan view of the fully scrambled image of FIG. 6, partly decoded, in which the decoding mechanism of FIG. 3 is out of phase with the partly decoded image.

Base image 4 is printed beneath scrambled image 14 in FIG. 1. Because base image 4 is the image from which scrambled image 14 was encrypted, it thus also decodes scrambled image 14. Because bars 5 of base image 4 correspond in width and spacing to the opaque bars used to hide part of image 2, a person can prepare a decoded scrambled image by printing base image 4 in phase with scrambled image 14, i.e. by printing bars 5 over the bars used to hide part of image 2. The image thus prepared would constitute a positive view of image 2, as exemplified in FIG. 7. Because bars 5 of base image 4 are the same width as transparent vertical columns 8 of base image 4, a person can also prepare a decoded scrambled image 14 by printing base image 4 out of phase with scrambled image 14, i.e. by printing bars 5 of base image 4 between the bars used to hide part of image 2. A negative view of image 2 is thus obtained, as exemplified in FIG. 8. Because a consumer could also decipher scrambled image 14 if base image 4 were printed over scrambled image 14 and in registration therewith, card 16 could be prepared with base image 4 printed over scrambled image 14 and still be within the scope of this invention.

Because the decoding mechanism and scrambled image are printed to the same substrate in the method of this invention, there is no need for a consumer to align a base image with a scrambled image in order to decode the scrambled image. This greatly expands the complexity of base images that can be employed, because there no longer is a need to use base images that can be aligned readily with the scrambled image. The integration of scrambled image and decoding mechanism onto the same substrate also greatly expands the number of base images that can be employed, because authorized individuals who decode scrambled images no longer need to maintain and use multiple decoders to decode scrambled images produced by more than one base image. The base image from which the image is scrambled can thus take many forms. The opaque bars need not be straight, parallel, or uniform in length, width or spacing. Opaque units other than bars can also be used for the base image, and these units can take any geometry or configuration. Moreover, the opaque units can be arranged in either an ordered or random pattern.

The potential variations in the base image, and the potential number of base images that can be employed, enhance tremendously the security associated with scrambling techniques. By using a base image that is random and disordered, one can greatly reduce the likelihood that an unauthorized individual will decipher the scrambled image without a decoder. By using multiple base images, one eliminates the risk that an unauthorized person who decodes one scrambled image could readily decode other scrambled images encrypted with the same base image.

The variability of the base image also increases the type of scrambling techniques that can be used. The opaque units from which the base image is constructed can be specifically tailored to best scramble a hidden image, yet also to provide superior resolution of the hidden image when decoded. For example, the base image could be configured to fill in only that part of an image that was erased during the scrambling process. The base image could also be configured selectively to cover the background meaningless imagery. The invention thus also enables the use of scrambling techniques for a variety of images for which a wide degree of resolution is desired.

Base image 4 is printed to card 16 in a manner that initially hides the base image from view, but by which base image 4 can subsequently be exposed to decode scrambled image 14. Because base image 4 is initially hidden from view, scrambled image 14 cannot initially be discerned when, for example, it is sold to a consumer or distributed in a promotion. Because base image 4 can subsequently be exposed, however, the consumer can manually reveal base image 4 to "play" the card.

Base image 4 can be printed to substrate 18 beneath scrambled image 14 by various means, including by use of reversible and irreversible inks that can change color or which can change from opaque to clear or vice versa. Inks that contain pigments such as titanium dioxide that change color when abraded by a coin, are particularly useful for printing base image 4. Reactive and photo-reactive inks that change color when they react with chemical compounds or upon exposure to light can also be employed to print base images, as can thermochromes that change color when they absorb energy such as light waves and encapsulated inks that burst when abraded. Any of these type inks would be suitable for printing base image 4 to the substrate beneath scrambled image 14, provided that the ink is compatible with substrate 16 and any other materials with which the ink comes into contact.

This invention can also be practiced by printing base image 4 or another suitable base image over top of scrambled image 14. If the ink selected is initially transparent, it can be applied over clear or opaque pixels 10 or 12, or other background imagery used to scramble an image, so that when the ink changes color it mimics the color of substrate 18 (or the color of image 2 if the pixels are contained within image 2). A transparent ink can also be applied over the suppressed portions of image 2, provided that when the transparent ink changes color it closely mimics the color of the unerased portion of image 2. Opaque or translucent inks similarly could be incorporated into scrambled image 14, either to hide image 2 or to create the meaningless background imagery.

The coloration and density of an ink when it is applied to card 16, and the coloration and density of the ink after it has changed color, are both important factors to be considered when choosing an appropriate ink. For example, if an ink is applied to substrate 18 in the suppressed portion of image 2, the ink should mimic the color of substrate 18 when initially applied, and it should mimic the color of image 2 when it changes color. Identity of color and density between image 2 and the exposed ink, or between substrate 18 and the ink when it is initially applied, is not, however, absolutely required. Rather, the color (or transparency) of an ink when initially applied need only prevent someone from readily distinguishing base image 4 from substrate 18 and thereby deciphering scrambled image 14. Similarly, the color (or transparency) of an ink after it has changed color need only be sufficient to enable a person to discern image 2.

The method of integrating a decoding mechanism into a substrate with an encrypted image can, of course, be practiced with techniques other than the bar coding technique discussed above, including those techniques described in U.S. Pat. Nos. U.S. Pat. No. 2,952,080 to Avakian et al, U.S. Pat. No. 3,621,589 to Jones et al, U.S. Pat. No. 3,279,095 to Carlson, and U.S. Pat. No. 3,227,474 to Hoeflinger. Indeed, the foregoing is provided for purposes of illustrating, explaining, and describing embodiments of the present invention. Modifications and adaptations to the embodiments will be apparent to those skilled in the art and may be made without departing from the scope and spirit of this invention.

What is claimed is:

1. A unit comprising:

(a) a substrate;

(b) a scrambled image printed onto the substrate, wherein the image has been scrambled by suppressing from view at least part of the image, by introducing to the image meaningless background imagery, or by a combination of both; and (c) a decoding mechanism printed onto the substrate, wherein the decoding mechanism at least partially fills in the part of the image suppressed from view, at least partially suppresses from view the meaningless background imagery, or does both, wherein the decoding mechanism is not initially apparent but which subsequently can be exposed to decode the scrambled image.

2. The unit of claim 1 wherein the at least part of the image has been suppressed from view by a series of bars.

3. The unit of claim 2 wherein the series of bars are parallel.

4. The unit of claim 2 wherein the series of bars are ordered in a somewhat random fashion.

5. The unit of claim 1 wherein at least part of the image has been suppressed from view by a plurality of forms.

6. The unit of claim 1 wherein the plurality of forms are ordered in a somewhat random fashion.

7. The unit of claim 1 wherein the decoding mechanism is at least partly selectively printed onto the suppressed part of the image.

8. The unit of claim 1 wherein the decoding mechanism is at least partly selectively printed onto the background imagery.

9. The unit of claim 1 wherein a plurality of pixels are introduced as the meaningless background imagery.

10. The unit of claim 9 wherein the plurality of pixels comprise both clear and opaque pixels, wherein the clear pixels are inserted into the unsuppresed part of the image, and the opaque pixels are inserted around the image and into the suppressed part of the image.

11. The unit of claim 1 wherein the decoding mechanism is transparent.

12. The unit of claim 1 wherein the decoding mechanism mimics the color of the substrate.

13. The unit of claim 1 wherein the decoding mechanism is printed onto the substrate using an ink selected from the group consisting of: reversible inks, irreversible inks, reactive inks, photo-reactive inks, thermochromes, and encapsulated inks.

14. A method of encoding information in a substrate comprising:

(a) printing a scrambled image onto a substrate, wherein the image has been scrambled by suppressing from view at least part of the image, by introducing to the image meaningless background imagery, or by a combination of both; and (b) printing onto the substrate a decoding mechanism that at least partially fills in the part of the image suppressed from view, that at least partially suppresses from view the meaningless background imagery, or that does both, wherein the decoding mechanism is not initially apparent but which subsequently can be exposed to decode the scrambled image.

* * * * *